US005954357A

United States Patent [19]

Golling

[11] Patent Number: 5,954,357

[45] Date of Patent: Sep. 21, 1999

[54] APPARATUS FOR GLIDING OVER SNOW

[76] Inventor: Eugene J. Golling, P.O. Box 15368, 1823 S. Hope St., Los Angeles, Calif. 90015

[21] Appl. No.: 09/058,087

[22] Filed: Apr. 9, 1998

[51] Int. Cl.[6] ..... A63C 9/00

[52] U.S. Cl. ..... 280/612; 280/14.2

[58] Field of Search ..... 280/612, 14.2, 280/611, 623; 269/8

[56] References Cited

U.S. PATENT DOCUMENTS

| | | | |
|---|---|---|---|
| 2,276,826 | 3/1942 | Crowther | 280/612 |
| 3,318,610 | 5/1967 | Kulick | 280/612 |
| 3,437,345 | 4/1969 | Berta | 280/612 |
| 3,667,771 | 6/1972 | Larson | 280/612 |
| 3,927,897 | 12/1975 | Olson et al. | 280/612 |
| 3,960,383 | 6/1976 | O'Neil | 280/612 |
| 5,156,644 | 10/1992 | Koehler et al. | 280/14.2 |
| 5,769,438 | 6/1998 | Svetlov | 280/87.041 |
| 5,820,155 | 10/1998 | Brisco | 280/607 |

*Primary Examiner*—J. J. Swann
*Assistant Examiner*—David R. Dunn
*Attorney, Agent, or Firm*—James E. Brunton

[57] ABSTRACT

A universal snow boot and binding for use in connection with either snow skiing of snow-boarding which is easy to use and provides quick, easy and positive interconnection of the snow boot with the upper surface of the ski or snow-board. Uniquely only magnetic forces are used to affix the snow boot to the ski or snow-board.

14 Claims, 9 Drawing Sheets

APPARATUS FOR GLIDING OVER SNOW

SPECIFICATION

BACKGROUND OF THE INVENTION

1. Field of the Invention

The present invention relates generally to a winter sport apparatus. More particularly, the invention concerns a novel winter sport apparatus for gliding over snow which includes unique snow boots which are removably connected to a snow engaging support base such as a snow-board or ski board through the use of magnets.

2. Discussion of the Prior Art

In recent years snow sports have continually increased in popularity. While, for many years snow skiing was the sport of choice among winter sport enthusiasts, recently, the sport of snow-boarding has catapulted into popularity particularly among young persons.

With the increase in popularity of snow boarding has come the demand for better and easier-to-use equipment. Particularly in demand is the need for superior boots and bindings. As a general rule, the boots and bindings used for snow boarding are the same as used for snow skiing and closely resemble those which have been used for over fifty years. Typically, the bindings comprise rather heavy, bulky frames which are affixed to the upper surface of the snow-board with the boots being affixed to the frames by conventional types of straps, buckles and wires of the character used in snow skiing. These type of bindings are generally cumbersome, difficult to use and often fail to provide a type of interconnection between the boots and the snow-board which is essential to the sport of snow boarding.

Among the more recent improvements in snow sport bindings are those described in U.S. Pat. No. 5,558,355 issued to Henry. The Henry patent describes a binding which is particularly suitable for snow boarding and provides an easy-to-use, kick-in boot engagement feature and a number of convenient ways to disengage the boot in a relative small, light-weight, and economical structure.

Another type of ski binding is disclosed in U.S. Pat. No. 5,143,397 issued to Stepanek et al. This patent describes a part for a ski binding comprising a carriage slidably attached to a base plate. One end of the base plate is fastened to the ski with fasteners while the other end rests freely on the bottom of a U-shaped clamp also fastened to the ski with fasteners. Attachment of the carriage to the base is accomplished by carriage structural features that retain the carriage in the clamp and further carriage structural features that prevent the carriage from being vertically disengaged from the part of the base adjacent to the base plate fastened end.

Still another improved binding for a snow-board is that described in U.S. Pat. No. 5,143,369 issued to Shaanan et al. The Shaanan et al patent concerns a binding for a snow-board that has a base, side members extending upwardly and rearwardly from the sides of the base with an arcuate member joining the rear ends of the side members. Fastening means on one of the side members and one side edge of the board at the front provide for attachment of one end of two straps. Fastening means on the other side member and on the other side edge serve for attachment of a locking bar which, in turn, connects the other end of each strap to the side member and base.

The foregoing prior art patents represent some of the more recent attempts to improve the quality of snow boots and bindings particularly for use in connection with snow boarding. While the devices disclosed in the aforementioned patents constitute substantial improvements over the prior art, they nevertheless remain somewhat complicated, bulky and difficult to use.

The thrust of the present invention is to overcome the drawbacks of the prior art snow-ski and snow-board boots and bindings and to provide a universal boot and binding which is easy to use and enables the quick and positive interconnection of the snow boots with the upper surface of the ski or snow-board.

SUMMARY OF THE INVENTION

It is an object of the present invention to provide a universal snow boot and binding for use in connection with either snow skiing or snow boarding which is easy to use and provides quick, easy and positive interconnection of the snow boot with the upper surface of the ski or snow-board. More particularly, it is an object of the invention to provide a highly novel snow boot and binding in which only magnetic forces are used to affix the snow boot to the ski or snow-board.

Another object of the invention is to provide an apparatus of the character described in the preceding paragraphs which is light-weight, is simple to manufacture and install, and is virtually fail-safe in operation.

Another object of the invention is to provide an apparatus of the aforementioned character which includes novel means for quickly and easily disconnecting the snow boot from the upper surface of the snow-board or snow ski which carries the magnetic elements of the apparatus.

Another object of the invention is to provide an apparatus as described in the preceding paragraph in which the release mechanism comprises an easy-to-use, hand-operated lever which enables the skier or the snow-boarder to quickly and easily disconnect the snow boot from the upper surface of the ski or snowboard.

Another object of the invention is to provide cooperating gripping means on the snow boot and the magnet to prevent accidental slippage of the snow boot relative to the magnet.

Another object of the invention is to provide a novel ski boot and cooperating binding which is compact, lightweight and of a simple, straight forward construction that and can be inexpensively manufactured.

DESCRIPTION OF THE INVENTION

Figure 1:
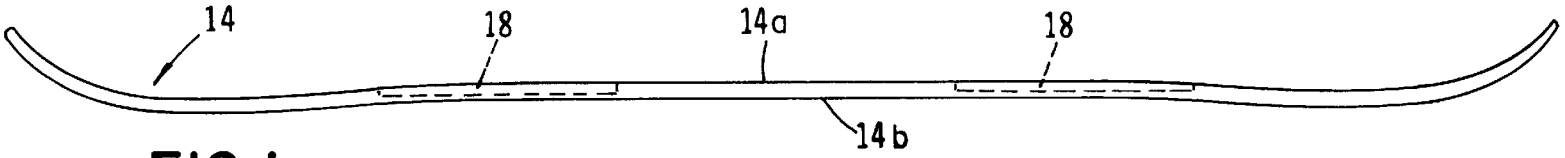
FIG. 1 is a side-elevational view of the support base portion of one form of the apparatus of the invention for gliding over snow.
Figure 2:
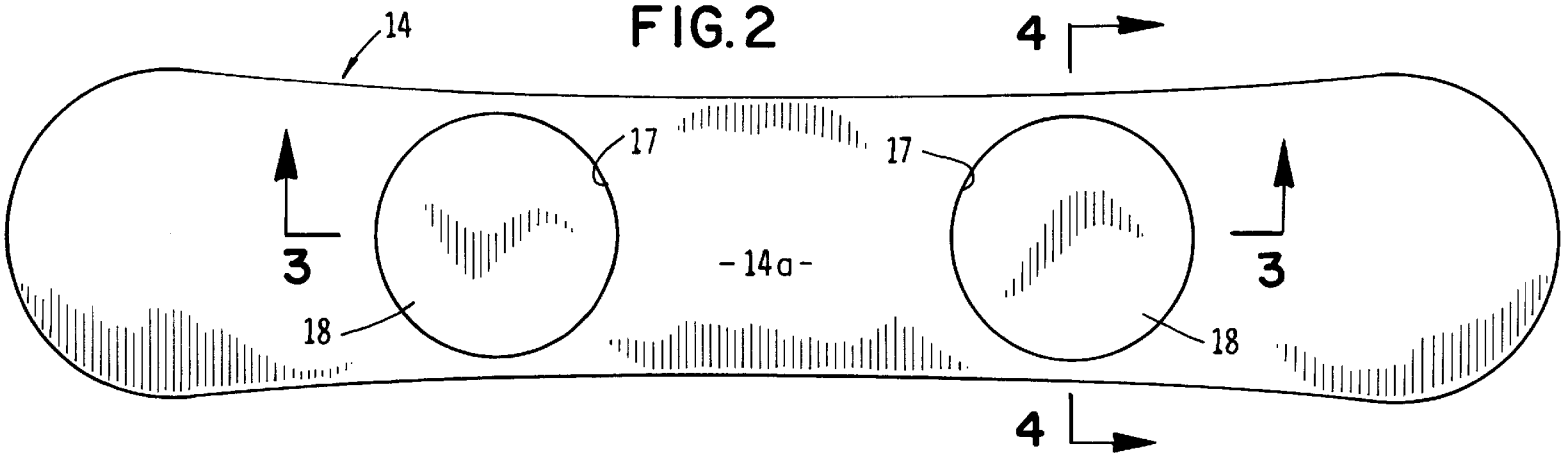
FIG. 2 is a top plan view of the support base shown in FIG. 1.
Figure 3:
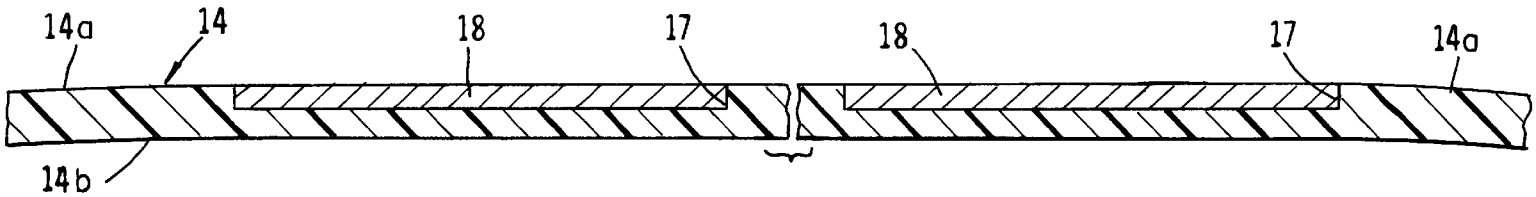
FIG. 3 is an enlarged, cross-sectional view taken along lines 3—3 of FIG. 2.
Figure 4:
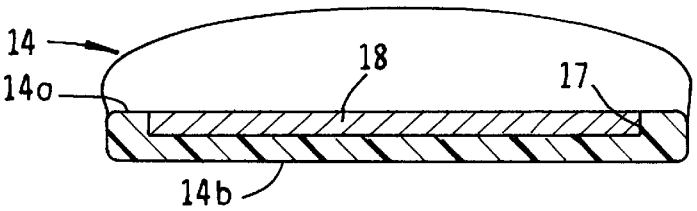
FIG. 4 is an enlarged, cross-sectional view taken along lines 4—4 of FIG. 3

Referring to the drawings and particularly to FIGS. 1 through 7, one form of the apparatus of the invention for gliding over snow is there shown. In this form of the invention, there are three principal cooperating components, namely, a support base 14, a foot enclosure assembly 16, and release means connected to the foot enclosure assembly for releasably interconnecting the foot enclosure assembly with the support base. Support base 14 includes an upper surface 14*a* and a lower surface 14*b* and, in the form of the invention shown in FIGS. 1 and 2, comprises a snow-board. As best seen in FIGS. 3 and 4, the upper surface 14*a* of support base 14 is provided with a pair of spaced-apart, generally circular shaped recesses 16 within which is mounted a generally circular shaped magnet 18. Magnets 18 are of a high holding power, compact design, and can be constructed from various materials. By way of example, magnets 18 can comprise powerful ceramic ring, permanent magnets which are readily commercially available from various sources including A-L-L Magnetics, Inc. of Palencia, Calif. These ceramic magnets can be constructed in various configurations and, if desired, can be encased in nickel-plated steel cups. Magnets 18 are commercially available in a number of different sizes and range in diameter from about 2 inches to about 5 inches. The larger of these magnets exhibit holding power of on the order of 200 pounds per magnet.

It is to be understood that in constructing the apparatus of the present invention, a single relatively large magnet can be used, or in the alternative, a plurality of smaller magnets disposed in a suitable array can be used to provide the magnetic forces necessary to releasably secure the foot enclosure assembly of the apparatus to the support base. By way of example a snowboard of a nominal length will require one magnet per foot enclosure with a pulling strength of about 150 pounds per magnet. This will achieve a total pulling strength of 300 pounds. The average weight of a person using a snow-board will typically be about 150 pounds. The magnets will then have double the pulling strength of the weight to be held in the desired position on the snow-board.

Figure 5:
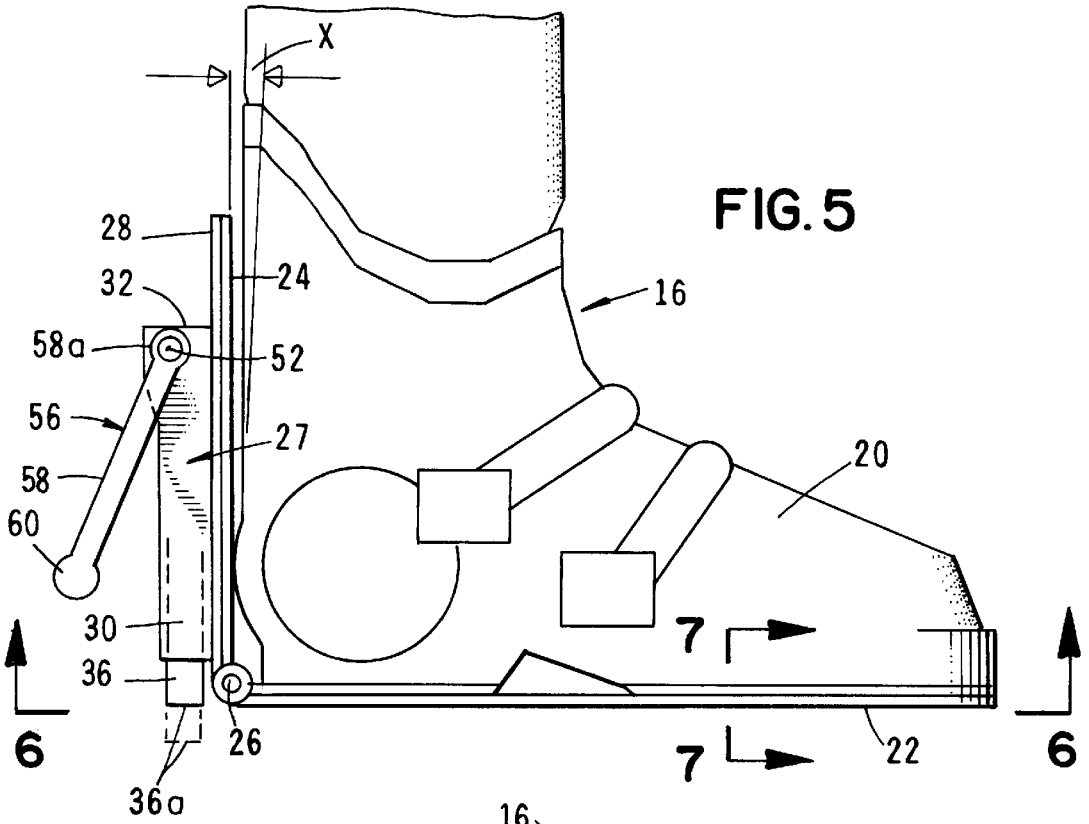
FIG. 5 is a side-elevational view of one form of the foot enclosure assembly of the apparatus of the invention.
Figure 6:
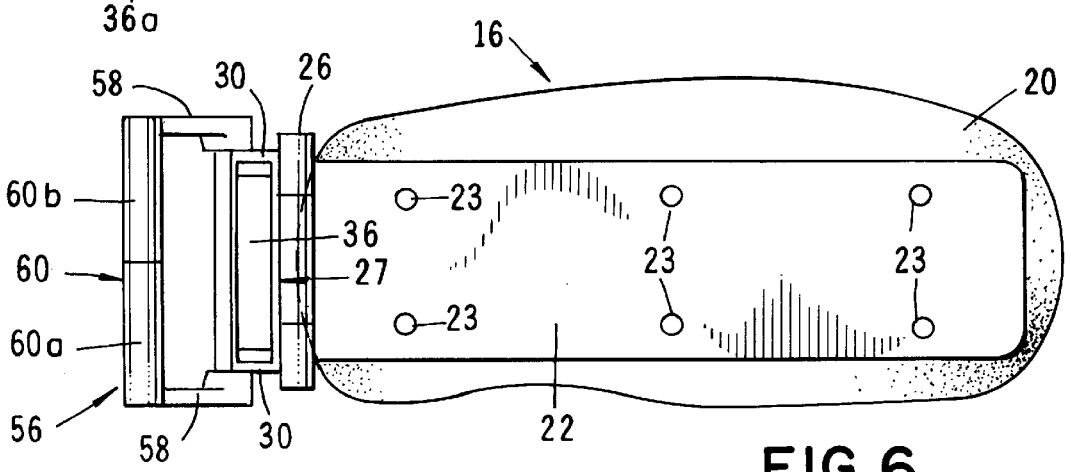
FIG. 6 is a view taken along lines 6—6 of FIG. 5.
Figure 7:
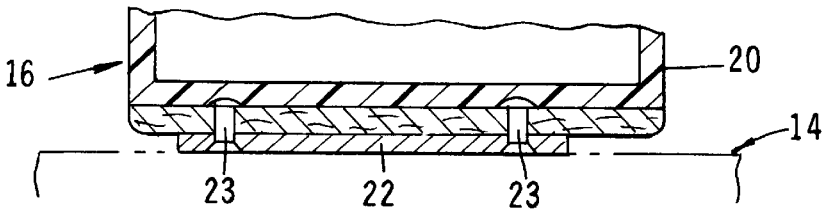
FIG. 7 is a greatly enlarged, cross-sectional view taken along lines 7—7 of FIG. 5.
Figure 8:
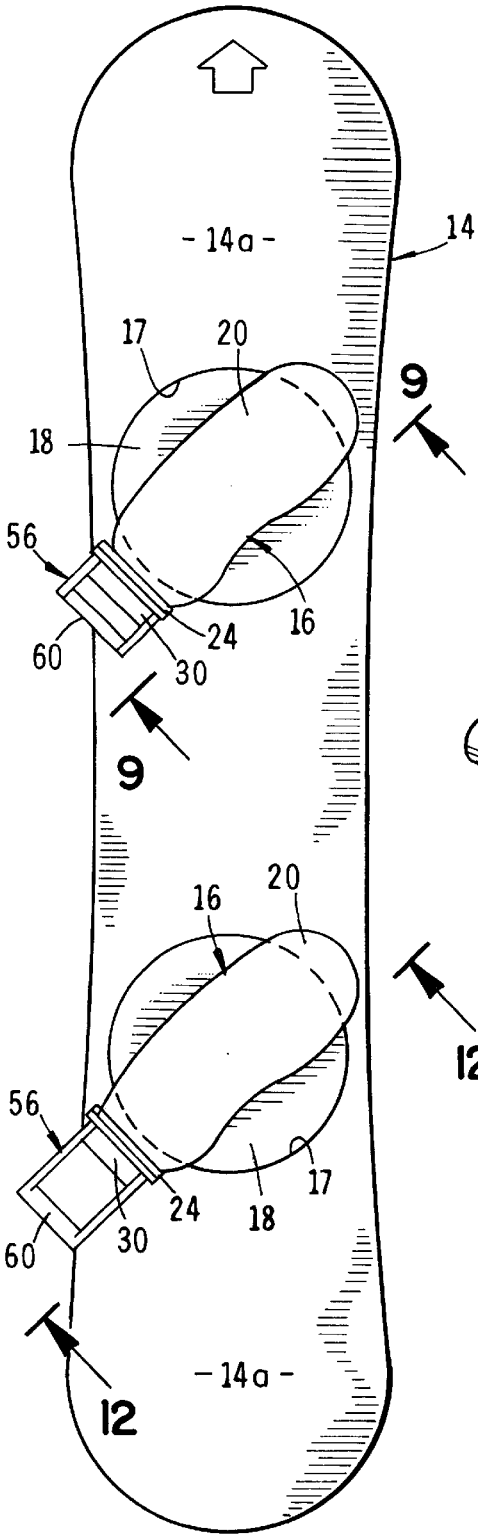
FIG. 8 is a top plan view similar to FIG. 2 but showing the foot enclosure assembly of the invention in position on the support base of the apparatus.

Referring to FIG. 5, the foot enclosure assembly 16 of the present invention can be seen to comprise a snow boot-like foot enclosure 20 and a first metal plate 22 which is affixed to the lower surface of the snow boot 20 by any suitable means such as rivets 23 (FIGS. 6 and 7). Plate 22 may be constructed from any suitable rigid metal which is capable of being attracted by the magnets 18 which are interconnected with the support base 14 by adhesive bonding or any other suitable means.

Also forming a part of the foot enclosure assembly of the invention is a second plate 24 which is pivotally connected to plate 22 for very limited movement of a few degrees about a pivot pin 26. More particularly, as shown in FIG. 5, plate 24 extends upwardly from plate 22 and normally is disposed generally perpendicularly with respect thereto. Plate 24 functions to provide support to the heel portion of the foot enclosure 20, but permits slight forward movement through a limited distance of X (FIG. 5). However, plate 24 positively resists rearward angular movement of the rear portion of the boot and lower leg of the user. The distance X can, of course, vary depending upon the physical stature of the user, but generally is on the order of about 1 inch. This movement is sufficient to permit the skier or snow boarder to comfortably lean forward in the binding but, at the same time, provides support against rearward angular leaning movement relative to plane of the support base.

Forming an important feature of the apparatus of the present invention is the release means for releasing the foot enclosure assembly from the support base. As best seen by referring to FIGS. 14 and 15, the release means here comprises a guide frame 26 which includes a rear plate 28 that is securely affixed to plate 24 of the foot enclosure assembly. Protruding rearwardly from plate 28 are a pair of transversely spaced-apart side members 30 and a top closure plate 32. Spaced-apart sides 30, along with a back wall or rear plate 38, cooperate to define a guideway 34 (FIG. 14) within which a release plate 36 is telescopically movable from the first upper position shown in FIG. 11 to the second, release position shown in FIG. 14. Rear plate 38 is provided with a vertically extending, elongated guide slot 40 (FIG. 13), which guides the vertical travel of a guide pin 42 which is affixed to release plate 36. With this construction, as release plate 36 moves from the first position shown in FIG. 11 to the release position shown in FIG. 14, guide pin 42 moves from a position proximate the upper extremity of guide slot 42 (FIG. 11) to a second position proximate the lower extremity of the guide slot 40 (FIG. 14).

Figure 15:
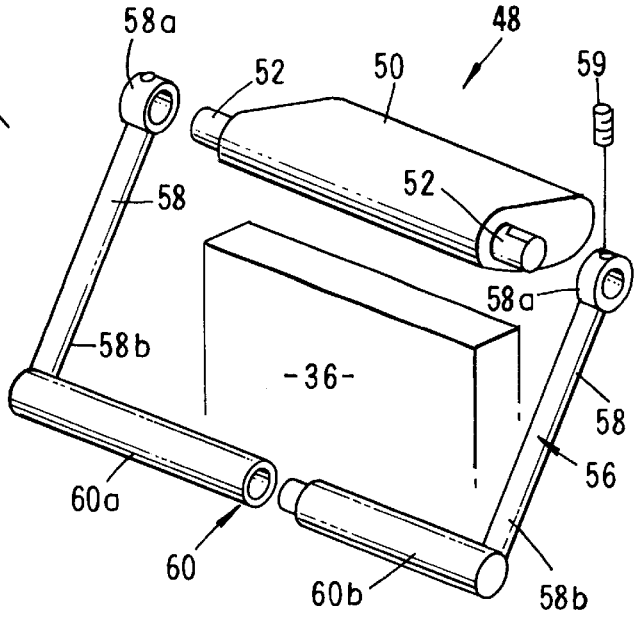
FIG. 15 is a generally perspective view of the upper portion of the release means of the apparatus of the invention for separating the foot enclosure from the support base.
Figure 10:
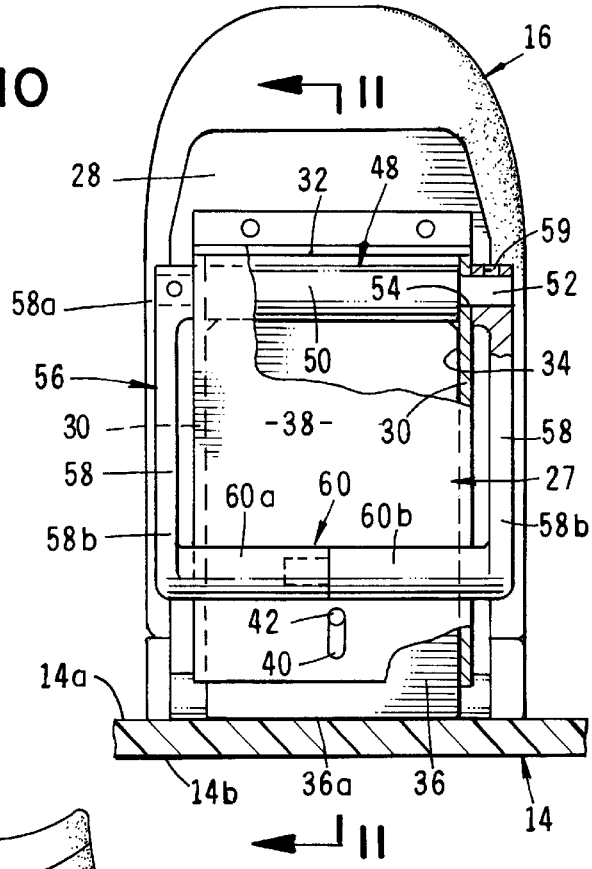
FIG. 10 is a view taken along lines 10—10 of FIG. 9.
Figure 9:
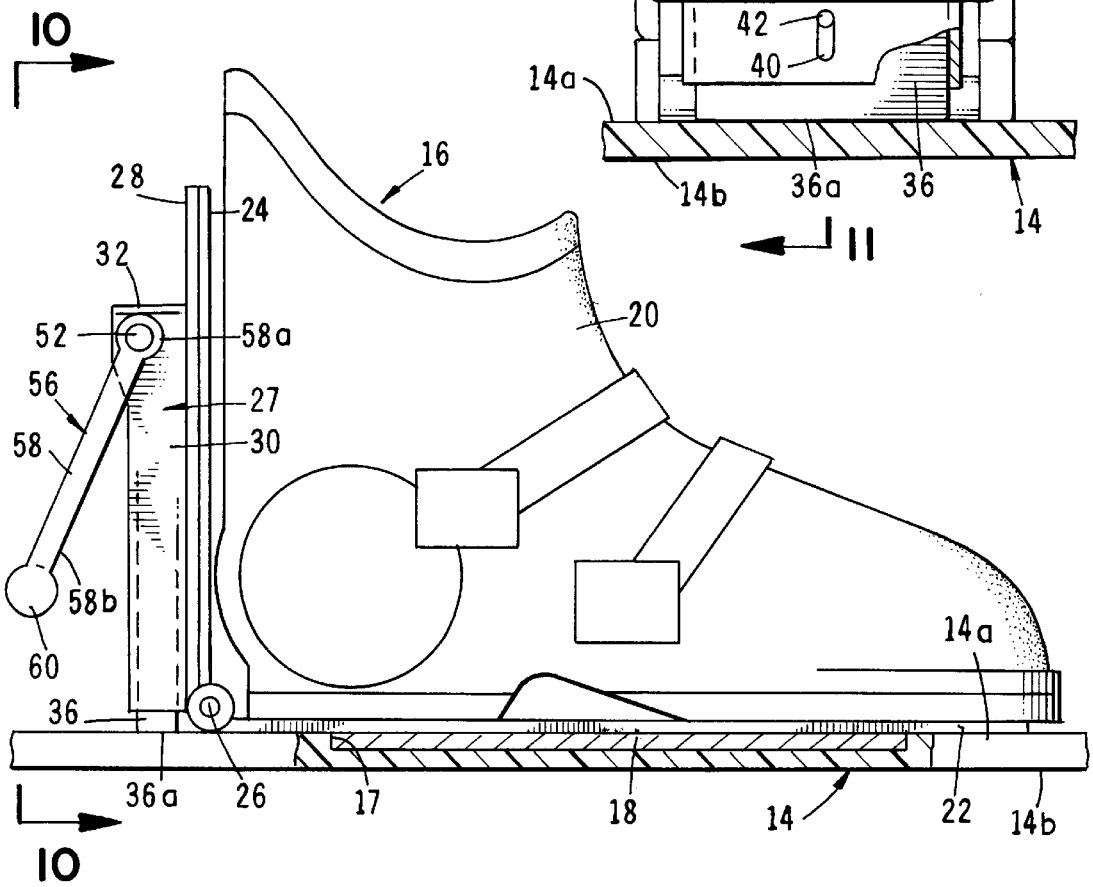
FIG. 9 is an enlarged view taken along lines 9—9 of FIG. 8.
Figure 11:
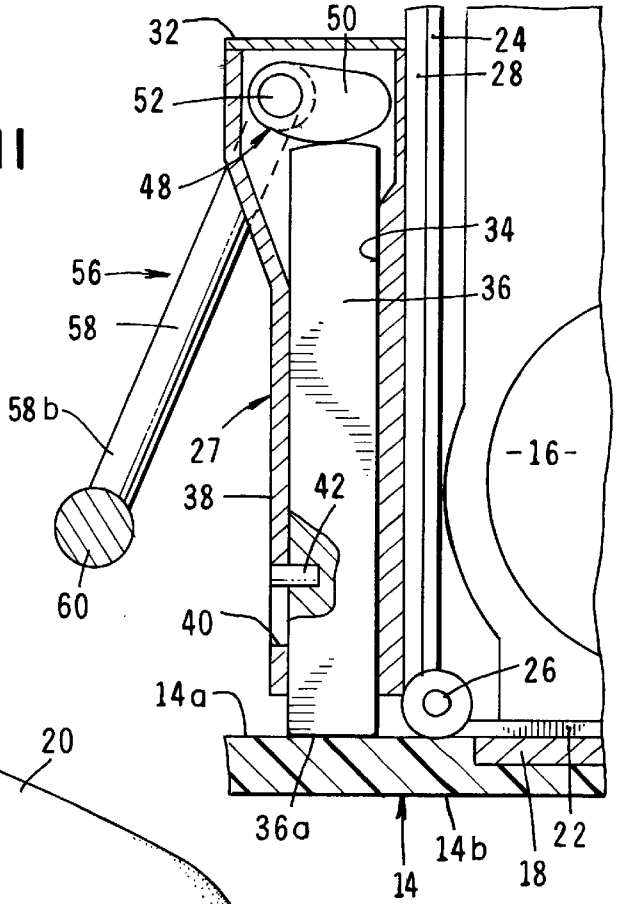
FIG. 11 is a cross-sectional view taken along lines 11—11 of FIG. 10.
Figure 12:
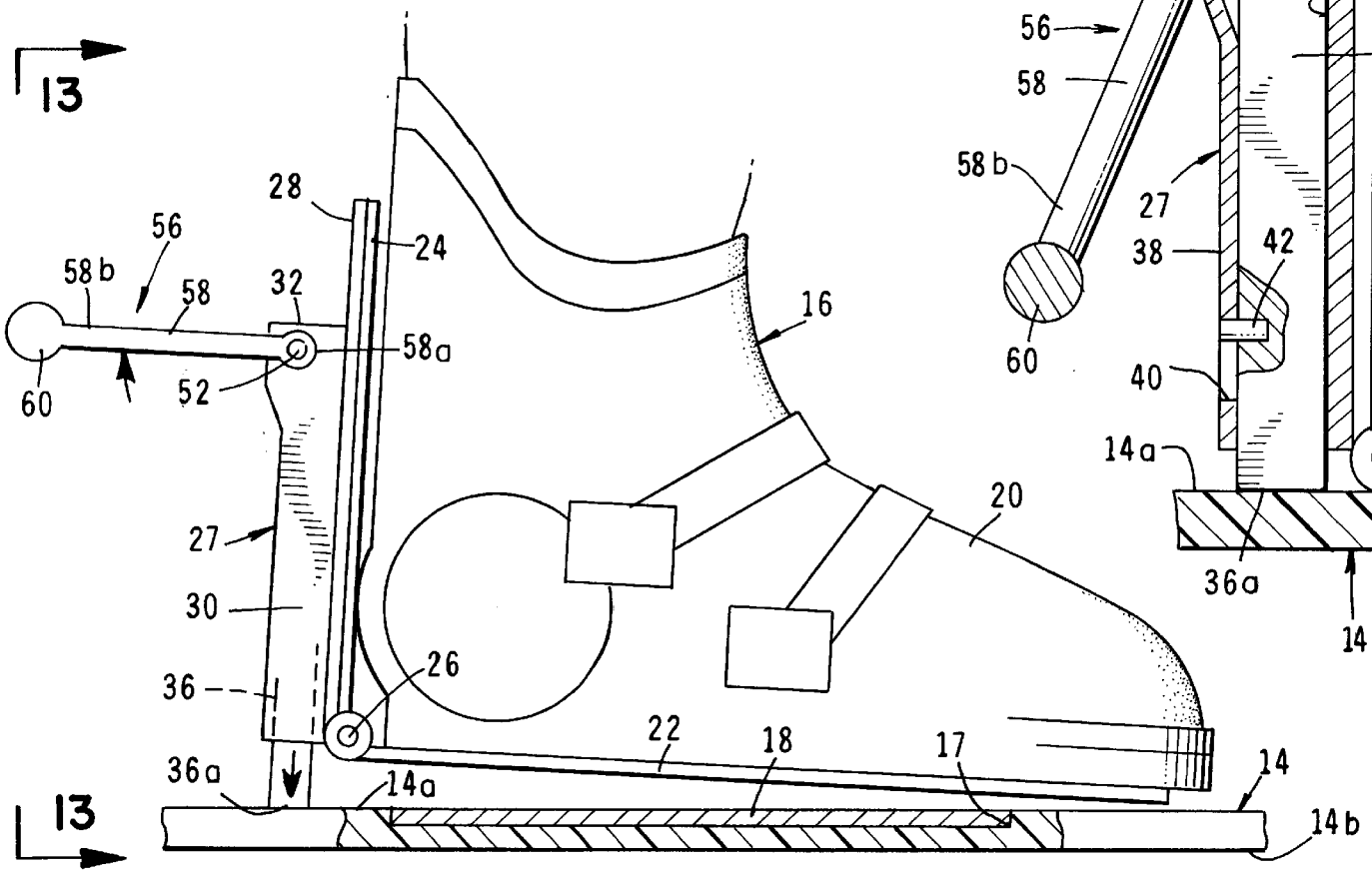
FIG. 12 is a side-elevational view similar to FIG. 5, but illustrating the manner of operation of one form of the operating means of the invention for disengaging the foot enclosure assembly from the magnet affixed to the support base.
Figure 14:
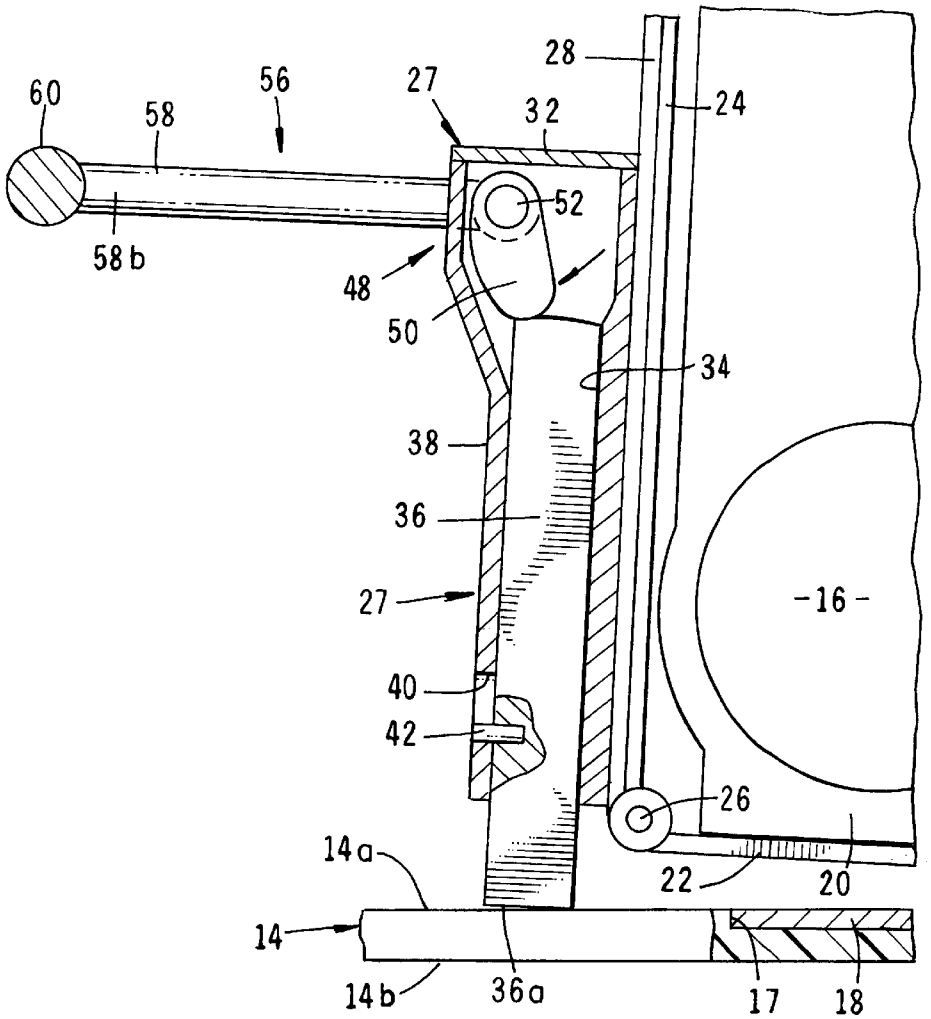
FIG. 14 is an enlarged, cross-sectional view taken along lines 14—14 of FIG. 13.
Figure 13:
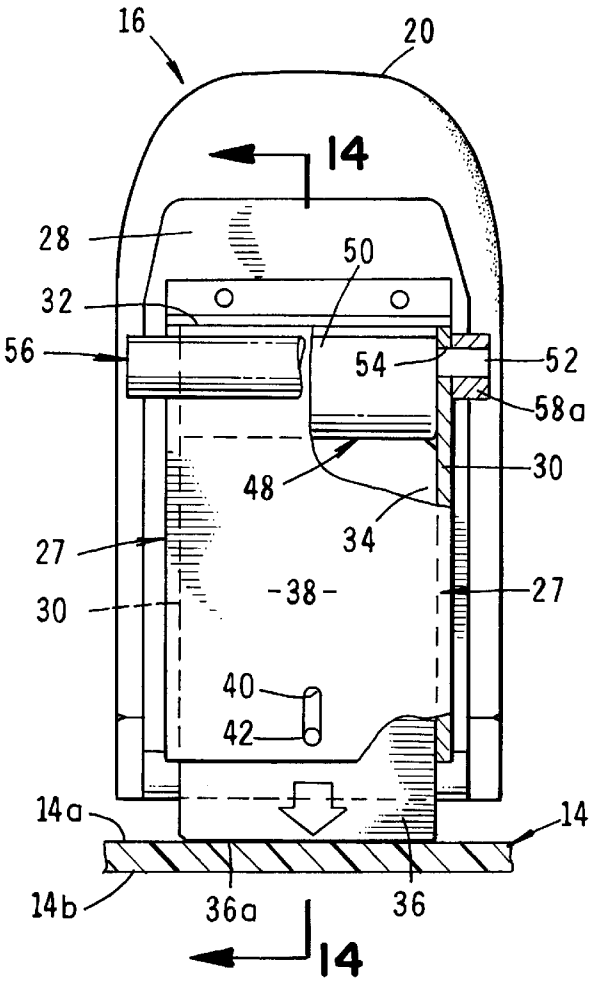
FIG. 13 is a view taken along lines 13—13 of FIG. 12.

In the embodiment of the invention shown in the drawings, release plate 36 is controllably moved from the uppermost position shown in FIG. 11 to the release position shown in FIG. 14 by operating means which here comprises as a cam assembly 48. Cam assembly 48 includes a cam member 50 having outwardly extending bosses 52 which are affixed at either side of the cam member in the manner shown in FIG. 15. As shown in FIG. 13, bosses 52 extend through aligned openings 54 provided in side walls 30 of FIG. 26. With this construction, a handle assembly 56 can be used to pivot cam member 50 from the position shown in FIG. 11 to the release position shown in FIG. 14. Handle assembly 56 of the character best seen in FIG. 15. As there shown, handle assembly 56 includes two spaced-apart side arms 58, each of which terminates at its upper end in a generally annular shaped connector 58*a* which is connected to bosses 52 of cam member 50 by suitable connectors such as a set screw 59 (FIG. 15). The opposite, or out board end 58*b* of each of the arm 58 is connected to a two-part handle member 60 comprising portions 60*a* and 60*b*. When portions 60*a* and 60*b* are interconnected in the manner shown in FIG. 10 the handle member can be grasped by the user in a manner to move the handle assembly from the position shown in FIG. 11 to the upward release position shown in FIG. 14. As shown in FIGS. 11 and 14, as the handle assembly is pivoted upwardly, release plate 36 will be forced downwardly by cam member 50 causing the lower extremity 36*a* thereof to move into pressural engagement with the upper surface 14*a* of the support base. As the handle assembly is urged upwardly in the manner shown in FIGS. 12 and 14, release plate 36 will be urged downwardly so that plate 22 will be separated from the magnet 18 thereby breaking the magnetic attraction and allowing separation of the foot enclosure assembly from the support base. Following separation of the foot enclosure assembly from the base plate, the handle assembly is, of course, pivoted downwardly into the starting position so that the foot enclosure assembly can, at such time as is desired, be reconnected to the base plate by superimposing plate 22 over a selected one of the magnets 18.

Figure 16:
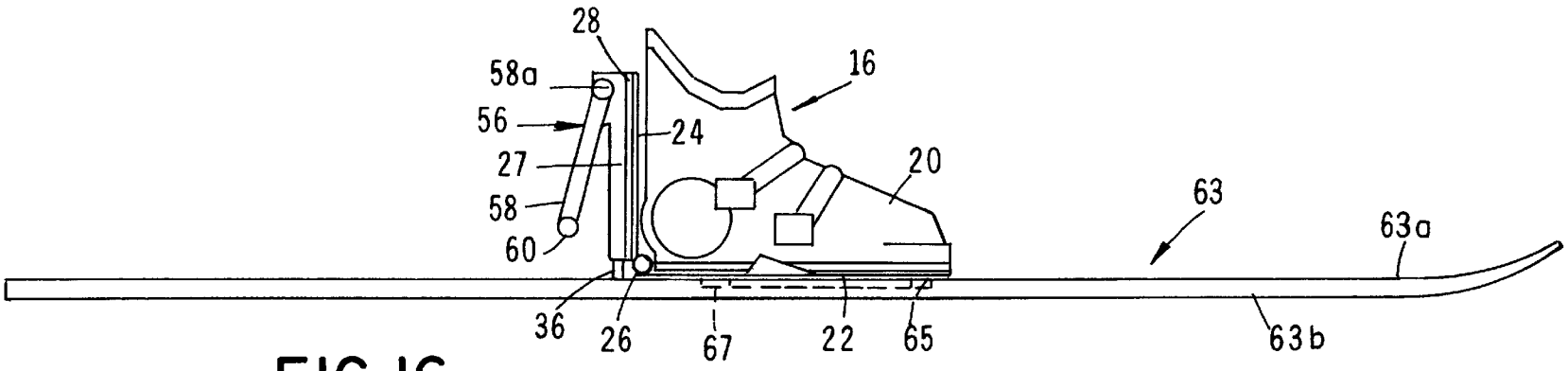
FIG. 16 is a side-elevational view of the apparatus of the invention for gliding over snow. In this form of the invention, the support base as shown in the form of a conventional ski rather than a snow-board.
Figure 17:
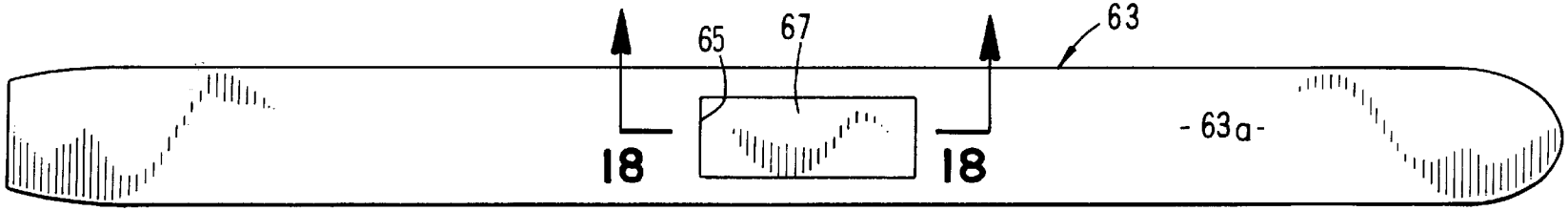
FIG. 17 is a top plan view of the support base portion of the apparatus shown in FIG. 16.
Figure 18:
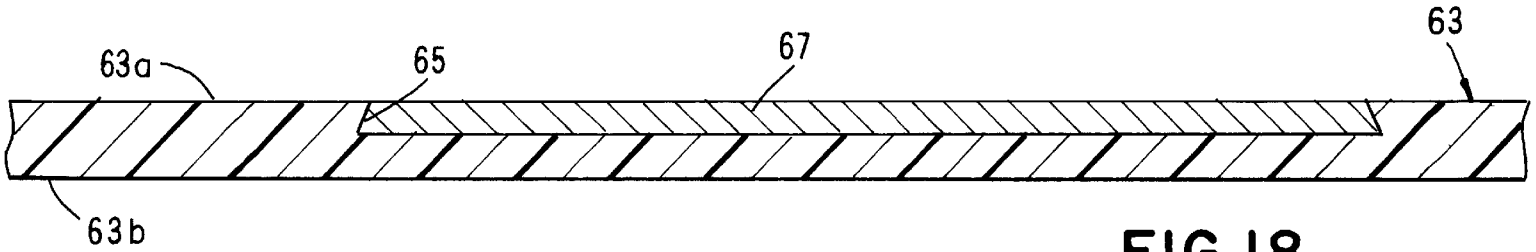
FIG. 18 is a greatly enlarged, cross-sectional view taken along lines 18—18 of FIG. 17.
Figure 19:
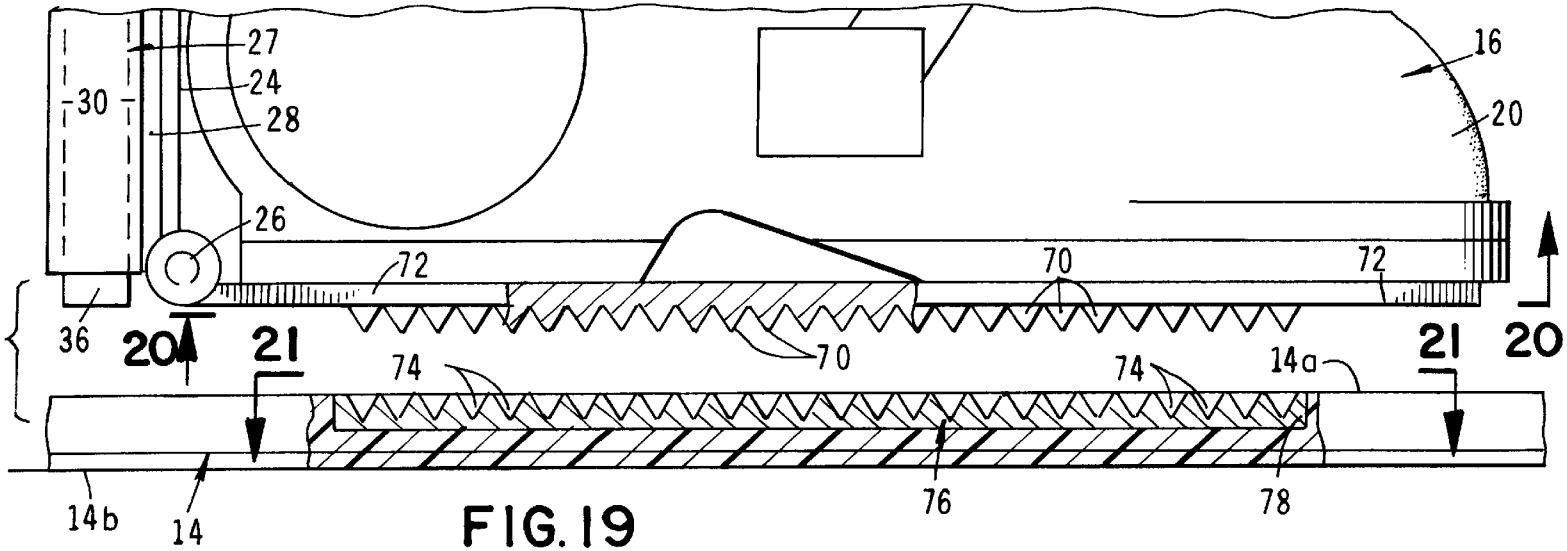
FIG. 19 is a side-elevational, exploded view, partly in cross-section showing an alternate embodiment of the invention.
Figure 22:
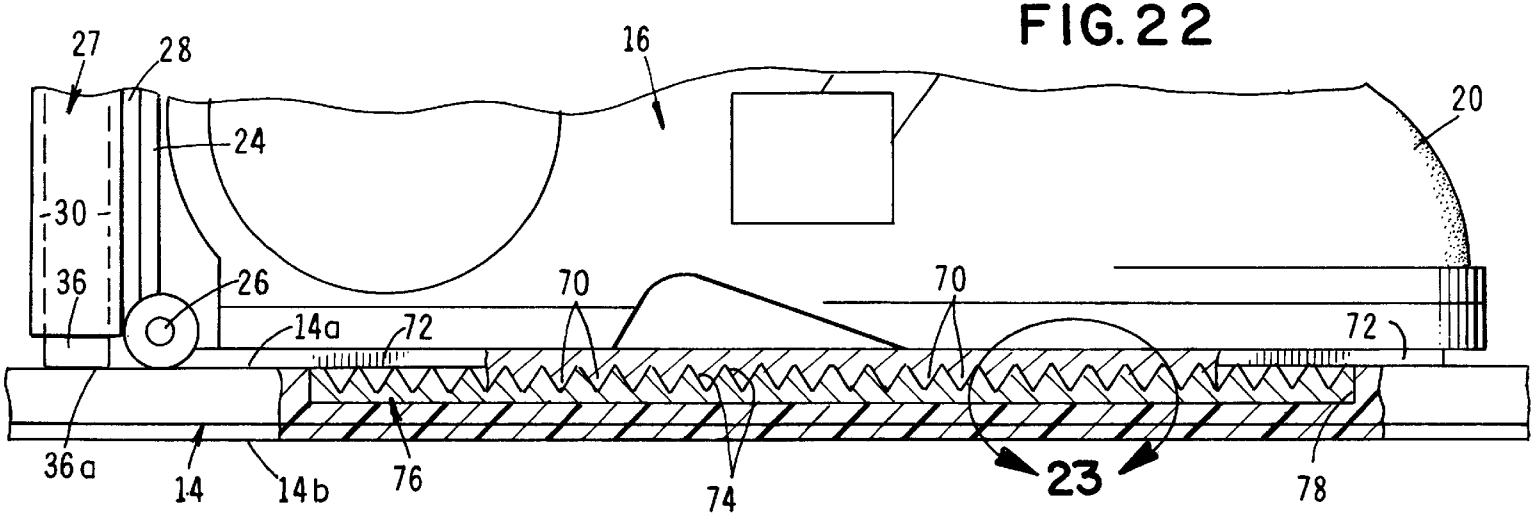
FIG. 22 is a side-elevational view similar to FIG. 19 but showing the foot enclosure assembly in engagement with the specially configured magnet.
Figure 20:
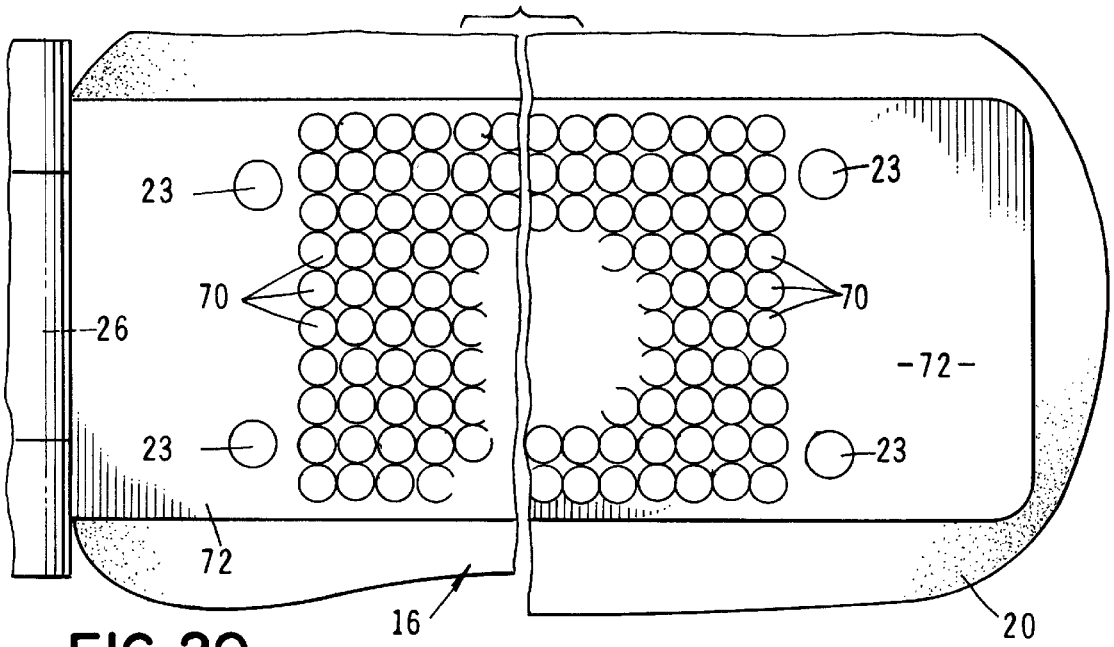
FIG. 20 is a foreshortened view taken along lines 20—20 of FIG. 19.

Turning next to FIGS. 16 through 18, an alternate form of the apparatus of the present invention for gliding over snow is there shown. This apparatus is similar in many respects to the apparatus shown in FIGS. 1 through 15. However, in this latest form of the invention the support base, rather than being a snowboard, comprises a ski 63 of a generally conventional configuration. Ski 63 has an upper surface 63*a*, and a lower snow engaging surface 63*b*. Upper surface 63*a* is provided with a generally rectangular shaped cavity 65 within which is affixed permanent magnet 67. Magnet 67 is of the same character as the magnets 18 previously discussed herein and is preferably constructed from a powerful magnetizable ceramic or metal material. Once again, magnet 67 should be designed to apply a force of approximately 150 pounds on the metal plate of the foot enclosure assembly which is identical to that previously described. Because the foot enclosure assembly, as well as the release means of this second apparatus of the apparatus is identical to that described in connection with FIG. 1 through 15, like numerals are used in FIG. 16 to identify like components of the foot enclosure assembly and release means. It is to be understood that when two skis are used, each ski is of the general construction shown in FIGS. 16 and 17 with each ski being provided with a magnet receiving cavity 65 and an appropriately powerful permanent magnet 67 embedded therewithin. Use of the release means of the invention to release the foot enclosure assembly from the ski is accomplished in the same manner as previously described herein.

Figure 23:
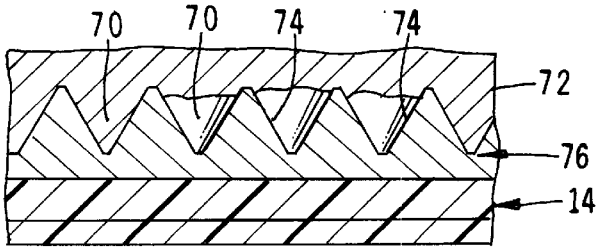
FIG. 23 is an enlarged, fragmentary view of the area designated in FIG. 22 by the numeral 23.

Turning to FIGS. 19 through 23, still another alternate form of the apparatus of the invention is there shown. This apparatus is similar in many respects to that illustrated in FIGS. 1 through 18 and like numerals are used in FIGS. 19 through 23 to identify like components. The major difference between the apparatus of the invention shown in FIGS. 19 through 23 and the earlier-described embodiments of the invention resides in the provision of anti-slip gripping means on the first metal base plates of the foot enclosure assemblies and on the magnets which are affixed to the support base of the apparatus. As best seen by referring to FIGS. 19 and 20, the gripping means provided on the metal base plates of each of the foot enclosure assemblies of the invention here comprises a multiplicity of downwardly extending, generally conically shaped, spike-like protuberances 70. Protuberances 70 extend downwardly from the central portion of metal base plate 72 of the foot enclosure assemblies of this latest form of the invention and as indicated in FIG. 23, are generally conical in shape.

Figure 21:
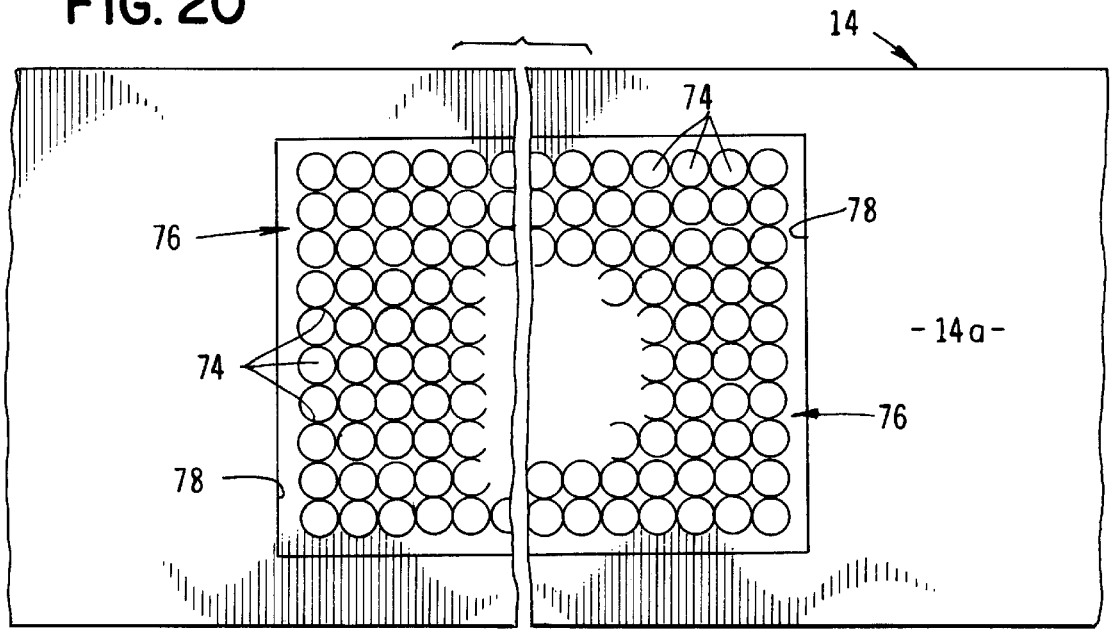
FIG. 21 is a foreshortened view taken along lines 21—21 of FIG. 19.

Also forming a part of the gripping means of this latest form of the apparatus of the invention are a multiplicity of generally conically-shaped cavities 74 which are formed in magnet 76 of this latest form of the invention. Depressions, or cavities 74, are of the same general size and configuration as conically shaped protuberances 70 so that when the foot enclosure assemblies are mated with the magnets, protuberances 70 will be received within cavities 74 so as to prevent slippage between metal plate 72 of the foot enclosure assemblies and magnets 76 which are affixed to support base 14. As best seen in FIG. 21 in this latest form of the invention, magnets 76 are generally rectangular in shape and are suitably secured within rectangularly shaped cavities 78 formed in the support bases.

It is to be understood that protuberances 70 can be of a number of different shapes. For example, the protuberances can comprise spaced-apart downwardly extending ribs which can be received within mating grooves provided in the magnets or, alternatively, they could be generally hub-like in shape and be received within socket-like cavities provided in the magnets. In any case, so long as the protuberances when received in mating cavities formed in the magnet function to prevent slippage between the foot enclosure assemblies and the magnets, their precise configuration is unimportant. In a similar fashion, the gripping means of the invention could comprise cooperating side frames provided on the foot enclosure assemblies and the magnet or support base to resist sliding movement of the foot enclosure assemblies relative to the support base.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

I claim:

1. An apparatus for gliding over snow comprising:

(a) at least one-foot enclosure assembly including a metal plate capable of being attracted by a magnet;

(b) at least one support base having an upper surface and a lower snow engaging surface;

(c) at least one magnet affixed to said at least one support base; and, (d) release means connected to said at least one foot enclosure assembly for releasing said metal base plate from said magnet, said release means comprising:

(i) a release plate connected to said at least one foot enclosure assembly, said release plate being movable from a first position to a second release position, whereby said metal plate is urged to separate from said magnet; and (ii) operating means operably associated with said release plate for moving said release plate from said first position to said second release position, said operating means comprising a cam member disposed in engagement with said release plate and an operating handle connected to said cam member for moving said cam member between a first position and a second position causing said release plate to pressurally engage said upper surface of said support base.

2. An apparatus for gliding over snow comprising:

(a) first and second foot enclosure assemblies, each including a metal plate capable of being attracted by a magnet;

(b) at least one support base having an upper surface and a lower snow engaging surface;

(c) at least one magnet affixed to said at least one support base; and (d) release means connected to each of said first and second foot enclosure assemblies for releasing said metal base plate from said magnet, each said release means comprising:

(i) a release plate connected to said foot enclosure assembly, said release plate being movable from a first position to a second release position, whereby said metal plate is urged to separate from said magnet; and (ii) operating means operably associated with said release plate for moving said release plate from said first position to said second release position, said operating means comprising a cam member disposed in engagement with said release plate and an operating handle connected to said cam member for moving said cam member between a first position and a second position causing said release plate to pressurally engage said upper surface of said support base.

3. An apparatus as defined in claim 2 in which said at least one support base comprises a snow ski.

4. An apparatus as defined in claim 2 in which said at least one support base comprises a snow-board.

5. An apparatus as defined in claim 4 in which a pair of magnets are affixed to said snow-board at spaced-apart locations.

6. An apparatus for gliding over snow comprising:

(a) first and second foot enclosure assemblies, each including a first metal plate capable of being attracted by a magnet and a second plate pivotally connected to said first metal plate;

(b) at least one support base having an upper surface and a lower snow engaging surface;

(c) at least one magnet affixed to said at least one support base; and (d) release means connected to each of said first and second foot enclosure assemblies for releasing said metal base plate thereof from said magnet, each said release means comprising:

(i) a guide frame connected to said foot enclosure assembly, said frame having interconnected front and side plates defining a guideway;

(ii) a release plate slidably movable within said guideway from a first position to a second release position; and (iii) operating means for moving said release plate from said first position to said second position.

7. An apparatus as defined in claim 6 in which said first metal plate of each said first and second foot enclosure assemblies include gripping means for grippingly engaging said at least one magnet.

8. An apparatus as defined in claim 7 in which said at least one magnet is provided with a multiplicity of cavities and in which said gripping means comprises a multiplicity of protuberances formed on said metal plates, said protuberances being receivable within said cavities.

9. An apparatus as defined in claim 7 in which said operating means comprises:

(a) a cam assembly pivotally connected to said guide frame; and (b) a handle assembly operably connected to said cam assembly.

10. An apparatus as defined in claim 9 in which said front plate of said release means is provided with a guide slot.

11. An apparatus as defined in claim 10 in which said release plate includes a guide pin, said guide pin being slidably movable within said guide slot of said front plate.

12. An apparatus for gliding over snow comprising:

(a) a foot enclosure assembly, including a metal plate capable of being attracted by a magnet;

(b) a support base having an upper surface and a lower snow engaging surface;

(c) a magnet affixed to said support base; and (d) release means connected to said foot enclosure assembly for releasing said metal base plate from said magnet, each said release means comprising:

(i) a release member connected to said foot enclosure assembly, said release member being movable from a first position to a second release position, whereby said metal plate is urged to separate from said magnet; and (ii) operating means operably associated with said release member for moving said release member from said first position to said second release position, said operating means comprising an operating member disposed in engagement with said release member and an operating element connected to said operating member for moving said operating member between a first position and a second position causing said release member to pressurally engage said upper surface of said support base.

13. An apparatus as defined in claim 12 including a pair of foot enclosures each having a metal base plate capable of being attracted by a magnet and a pair of magnets affixed to said support base at spaced-apart locations.

14. An apparatus as defined in claim 12 including:

(a) first and second foot enclosure assemblies each having a metal plate capable of being attracted by a magnet;

(b) first and second support bases each having an upper surface;

(c) a magnet affixed to each of said first and second support bases; and (d) release means connected to each said first and second foot enclosure assembly for releasing said metal plates thereof from said magnets.

* * * * *